US005890578A

United States Patent [19]

Kwon

[11] Patent Number: 5,890,578

[45] Date of Patent: Apr. 6, 1999

[54] TERMINAL RAIL SYSTEM FOR ESCALATOR

[75] Inventor: Yi Sug Kwon, Changwon, Rep. of Korea

[73] Assignee: LG Industrial Systems Co., Ltd., Seoul, Rep. of Korea

[21] Appl. No.: 956,536

[22] Filed: Oct. 23, 1997

[30] Foreign Application Priority Data

Oct. 23, 1996 [KR] Rep. of Korea ..... 1996/47645

[51] Int. Cl.[6] ..... B66B 23/12

[52] U.S. Cl. ..... 198/332

[58] Field of Search ..... 198/326, 330, 198/332

[56] References Cited

U.S. PATENT DOCUMENTS 4,576,276 3/1986 Boltrek et al. ..... 198/332

5,148,906 9/1992 Brunn ..... 198/332 X

*Primary Examiner*—James R. Bidwell

*Attorney, Agent, or Firm*—Birch, Stewart, Kolasch & Birch, LLP

[57] ABSTRACT

The terminal rail system for an escalator includes a pair of terminal rails including a corresponding pair of curved portions thereof having identical curvatures therebetween, a curve start point of either of the terminal rails being displaced from that of the other of the terminal rails, in a pair of terminal rails for an escalator which include a pair of curved portions thereof for guiding therearound a pair of step rear rollers engaged to an escalator step, and a pair of linear portions for guiding therealong the pair of step rear rollers toward the curved portions. The system completely eliminates the noise and vibration caused by an impact of the step rear rollers on the upper casing of the terminal rail.

3 Claims, 6 Drawing Sheets

TERMINAL RAIL SYSTEM FOR ESCALATOR

BACKGROUND OF THE INVENTION

1. Field of the Invention

The present invention relates to an escalator, and more particularly to an improved escalator terminal rail system capable of minimizing noise and vibration caused by an impact resulting from a step rear roller passing through a curved channel formed in the terminal rail system.

2. Description of the Prior Art

As shown in FIGS. 1 and 2, a conventional escalator includes: a pair of hand rails 1 for concurrently moving along a track thereof; a step unit 2 for transporting passengers; and a mechanical assembly 3 for driving the hand rails 1 and the step unit 2.

The mechanical assembly 3 includes: a driving unit provided with a motor 4, a speed reducer 5, a driving chain 6, a driving sprocket 7, a first terminal gear 8, a second terminal gear 11, a driving shaft 12 and a terminal rail 13; and the step unit 2 includes a moving unit provided with a plurality of steps 9, a step chain 10, a step front roller 14, and a step rear roller 15.

With reference to FIGS. 3 and 4, the terminal rail 13 is provided with a semicircular inner casing 18 and a semicircular outer casing 19, wherein an end portion of the inner casing 18 is engaged to an upper end portion of a lower guide rail 17.

The thusly constituted conventional terminal rail system serves to guide the step rear rollers 15 but lacks any means of removing or decreasing noise or vibration, and a generally adopted method therefor is to relieve an escalation impact by simply applying a precise fabrication to the terminal rail 13 so as to maintain a minimum gap between the inner casing 18 and the outer casing 19, through which gap does the step rear rollers 15 pass.

The operation of the thusly constituted conventional escalator will now be described.

First, force generated by the motor 4 in the mechanical assembly 3 is transferred to the speed reducer 5. In accordance with driving of the sprocket 7 connected to the speed reducer 5, the driving chain 6 is driven. The first terminal gear 8 sharing a shaft with the driving sprocket 7 operates the step chain 10 engaged to the steps 9 which circulate between the first terminal gear 8 and the second terminal gear 11.

Here, the step front rollers 14 travel along the upper guide rail 16, and the step rear rollers 15 travel along the lower guide rail 17, so that as each step 9 arrives at an upper or lower end portion of the escalator, the step rear roller 15 thereof is guided around through the curved channels formed in the terminal rails 13.

Especially, as shown in FIG. 4, at the upper and lower end portions of the escalator, the step front rollers 14 are turned around engaged to the terminal gear 8, and the step rear rollers 15 are turned around along the U-shaped terminal rail 13. At this time, each step rear roller 15 initially travels in contact with an outer surface of the inner casing 18, and when the step rear roller 15 comes up to the curved portion of the terminal rail 13, the step rear roller 15 begins turning around being in close contact with an inner surface of the outer casing 19.

However, the above-described conventional terminal rail 13 has a disadvantage, in that during an operation of the escalator, the step rear rollers 15 at the upper or lower end portions of the escalator impacts against the inner surface of the outer casing 19 therein, thereby generating considerable noise and vibration.

The noise and vibration caused by such impacts poses a serious problem in the conventional escalator that has yet to be solved, and despite continuous efforts made so far to overcome such a disadvantage, the noise and vibration still remain problems.

Recently, in an effort to find the causes of such noise and vibration, there has been carried out a noise measurement experiment employing a Taguchi experimental method which takes into account all the possible noise factors.

FIG. 5 illustrates effects of respective noise generating factors under the Taguchi method, wherein the steeper the slope of any of the factors in the graph, the more effective it becomes to restrain from noise occurrence.

The experiment has revealed that the cause of noise and vibration occurring when the steps 9 turn around at the upper and lower end portions of the escalator, is attributed to the terminal rail 13. Meanwhile, it is also proved that "C" factors as shown in FIG. 5 have relation to an increase or decrease in the impact-caused noise and vibration simply resulting from an impact caused by the step rear rollers 15.

Here, minium is employed in order to discover noise mechanism and location being impacted thereon with regard to the terminal rail 13, and as shown in FIG. 6, the step rear roller 15 travels along the outer surface of the semicircular inner casing 18 of the terminal rail 13 and is deviated away from a curve start point B of the outer surface of the inner casing 18. Then, the step rear roller 15 impacts upon a portion A (spaced about 45 degrees upwardly from an imaginary line extended from a horizontal surface line of the inner casing 18) of the inner surface of the outer casing 19 of the terminal rail 13, and is turned around on and along the inner surface of the outer casing 19 of the terminal rail 13.

More specifically, as shown in FIGS. 7A and 7B, the step rear rollers 15*a*, 15*b* respectively proceed along the inner casings 18 of the terminal rails 13*a*, 13*b*, and concurrently swing up against portions "A" of the outer casing 19. In short, the step rear rollers 15A, 15B travelling along the conventional terminal rails 13 swing up from the curve start point "B" to the portion "A" of the outer casing 19 while proceeding along the semicircular inner casing 18 of the terminal rail 13.

That is, the step rear rollers 15A, 15B impact upon portions "A" of the outer casing 19 positioned upwardly by a certain angle from an imaginary line horizontally extended from a flat surface line of the inner casing 18, instead of onto portions of the outer casing 19 directly extended from the flat surface line of the inner casing 18, wherein the upward impact of the step rear rollers 15A, 15B on portions "A" is caused by a lifting force induced when the step front roller 14 is turned round engaged to the terminal gear 8.

Also, according to a track experiment of the step rear rollers 15A, 15B being guided by the terminal rail 13, the step rear rollers 15A, 15B are known to impose a considerable amount of pressure and impact on the outer casing 19 of the terminal rail 13.

Since the track of the step rear rollers 15A, 15B remains unchanged during the operation of the escalator, the step rear rollers 15A, 15B render repeated impacts on the portions "A" of the terminal rail 13, thereby generating serious noise and vibration.

Conclusively, the conventional terminal rail system for an escalator has several disadvantages as follows.

First, the step rear rollers generate a significant amount of noise with each impact on the portion A.

Second, each instance the step rear rollers impact on the portion A at an average rate of 0.8 sec/step, the thusly amplified pulsation increases vibration of the steps.

Third, the step rear rollers and the terminal rail directly impact against each other, thereby decreasing the longevity of each.

Fourth, the rougher the inner surface of the outer casing, the greater becomes the noise.

Fifth, in order to decrease the noise and vibration caused by the impacting of the step rear rollers on the portion A, the gap between the semicircular inner casing and the outer casing may be set by a precise fabrication thereof, thereby increasing cost and lowering productivity in the fabrication and assembly thereof.

SUMMARY OF THE INVENTION

Accordingly, it is a first object of the present invention to provide a terminal rail system for an escalator capable of decreasing noise and vibration caused by an impact resulting from a step rear roller.

It is a second object of the present invention to provide a terminal rail system for an escalator for reducing vibration of steps in an escalator by preventing pulsation from occurring during an impact of step rear rollers on a terminal rail.

It is a third object of the present invention to provide a terminal rail system for an escalator capable of expanding longevity of step rear rollers and terminal rails by preventing an impact between the step rear rollers and the terminal rails.

It is a fourth object of the present invention to provide a terminal rail system for an escalator capable of facilitating a terminal rail fabrication and its assembly to an escalator, thereby obtaining improved productivity and cost reduction.

To achieve the above-described objects, the terminal rail system for an escalator according to the present invention is provided with a pair of terminal rails including a corresponding pair of curved portions thereof having identical curvatures therebetween, a curve start point of either of the terminal rails being displaced from that of the other of the terminal rails, in a pair of terminal rails for an escalator which include a pair of curved portions thereof for guiding therearound a pair of step rear rollers engaged to an escalator step, and a pair of linear portions for guiding therealong the pair of step rear rollers toward the curved portions.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE INVENTION

With reference to the accompanying drawings, a terminal rail system for an escalator in accordance with the present invention will now be described.

Figure 1:
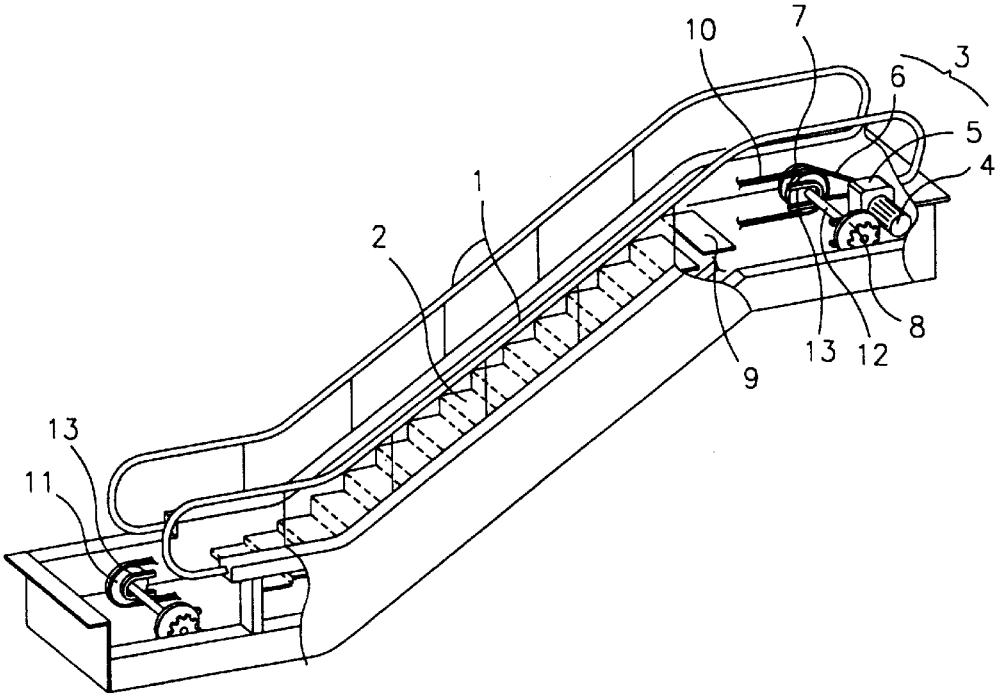
FIG. 1 CONVENTIONAL ART
FIG. 1 is a partially sectioned perspective view illustrating an internal and external structure of a general escalator.
Figure 2:
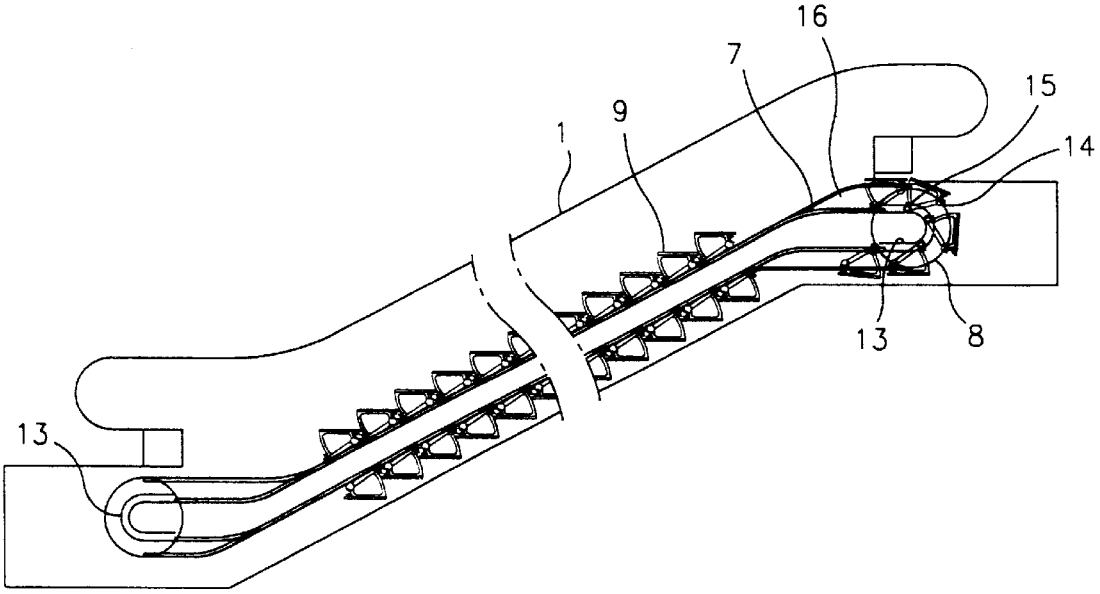
FIG. 2 CONVENTIONAL ART
FIG. 2 is a cross-sectional side view illustrating a step-moving state of the general escalator.
Figure 3:
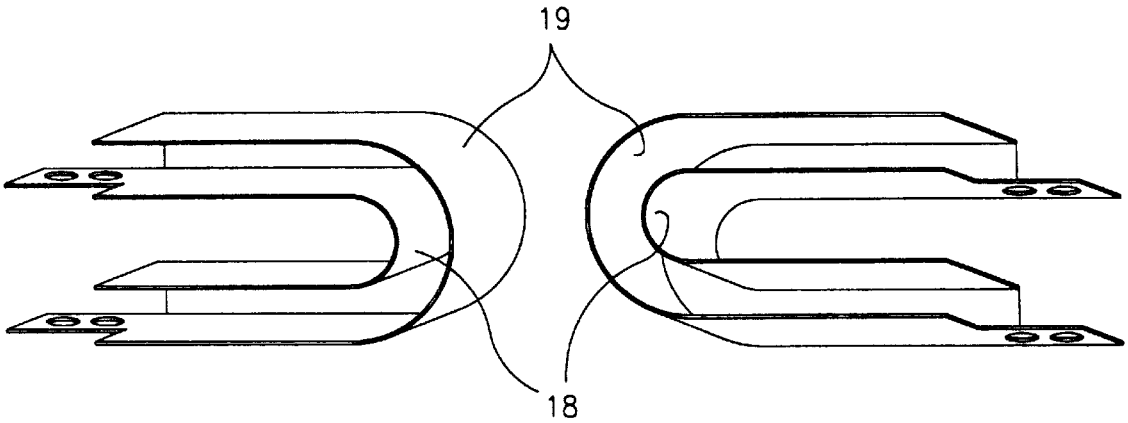
FIG. 3 CONVENTIONAL ART
FIG. 3 is a perspective view illustrating a terminal rail structure for an escalator according to the conventional art.
Figure 4:
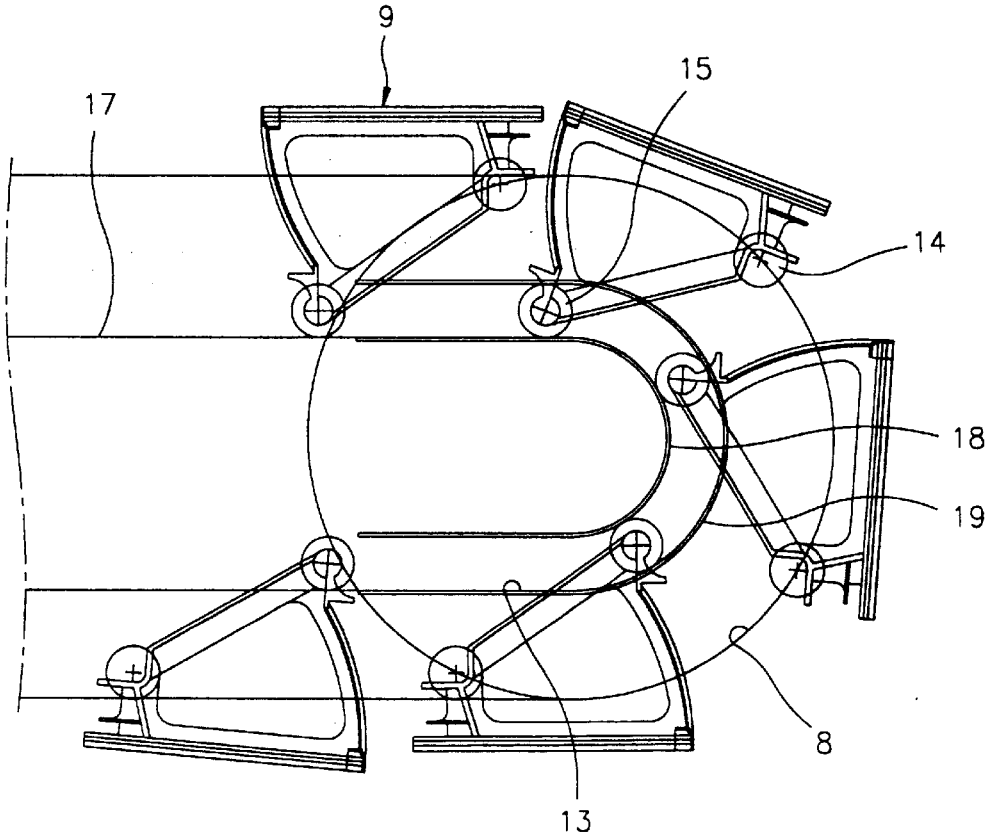
FIG. 4 CONVENTIONAL ART
FIG. 4 is a composite view illustrating the terminal rail combined with a guide rail according to the conventional art.
Figure 5:
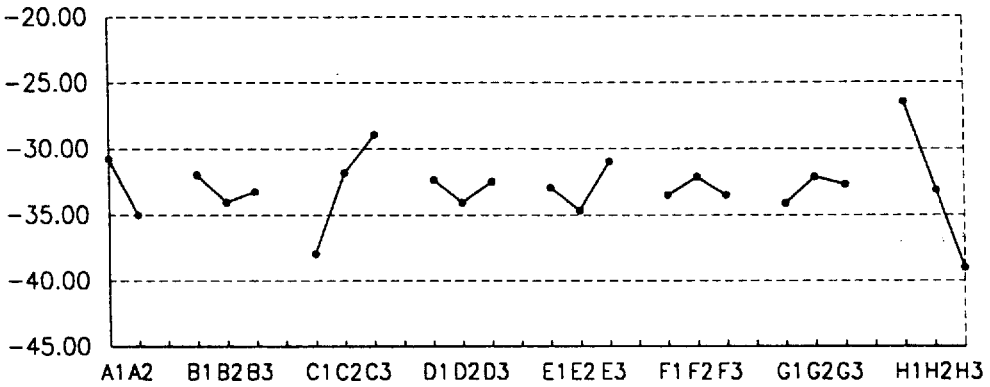
FIG. 5 CONVENTIONAL ART
FIG. 5 is a graph illustrating S/N ratio resultants and effects of noise factors disclosed in accordance with a Taguchi experimental method according to the conventional art.
Figure 6:
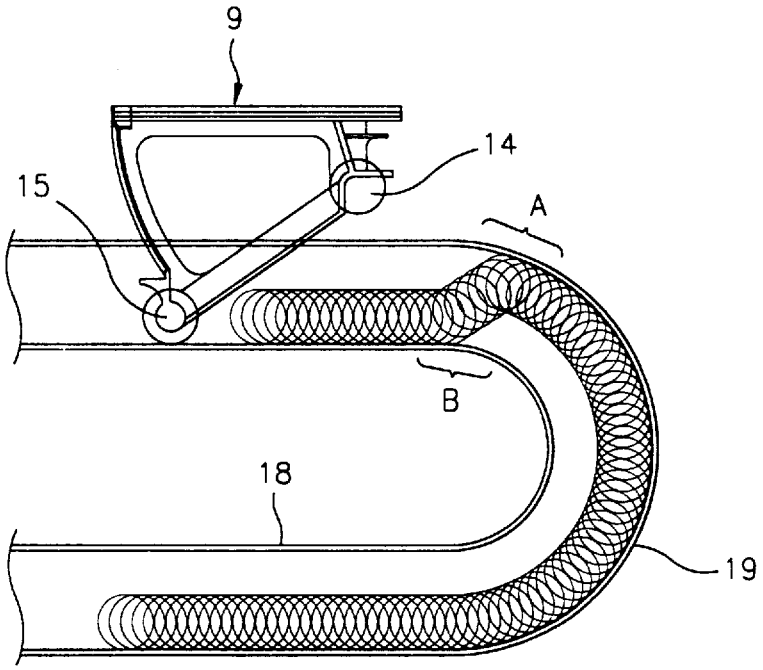
FIG. 6 CONVENTIONAL ART
FIG. 6 is a track variation view illustrating movement of a step rear roller passing through the terminal rail during operation of the conventional escalator.
Figure 7A:
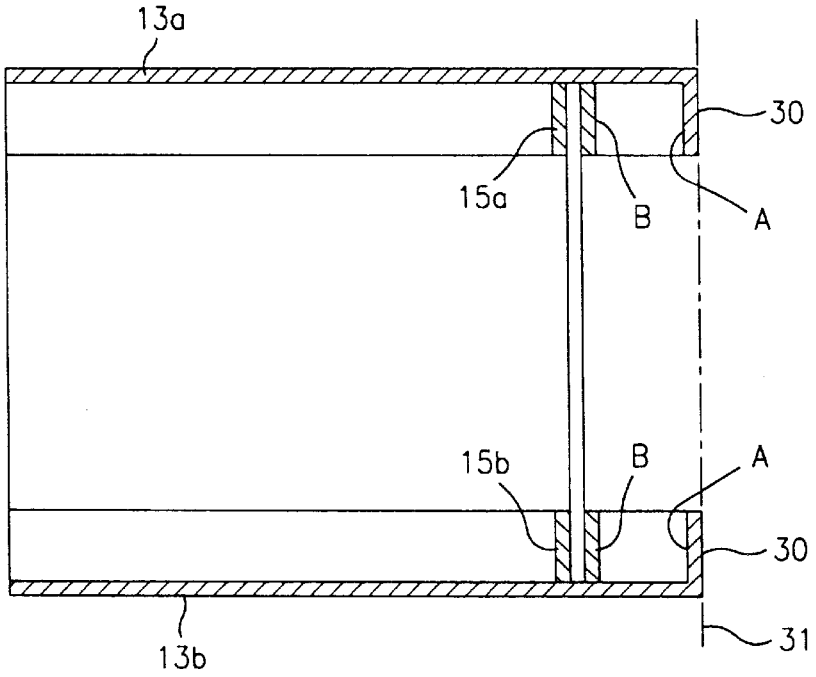
FIG. 7A CONVENTIONAL ART
FIG. 7A is a cross-sectional plan view illustrating a state in which the step rear rollers traveling along the terminal rail have reached a curve start point B in the conventional art.
Figure 7B:
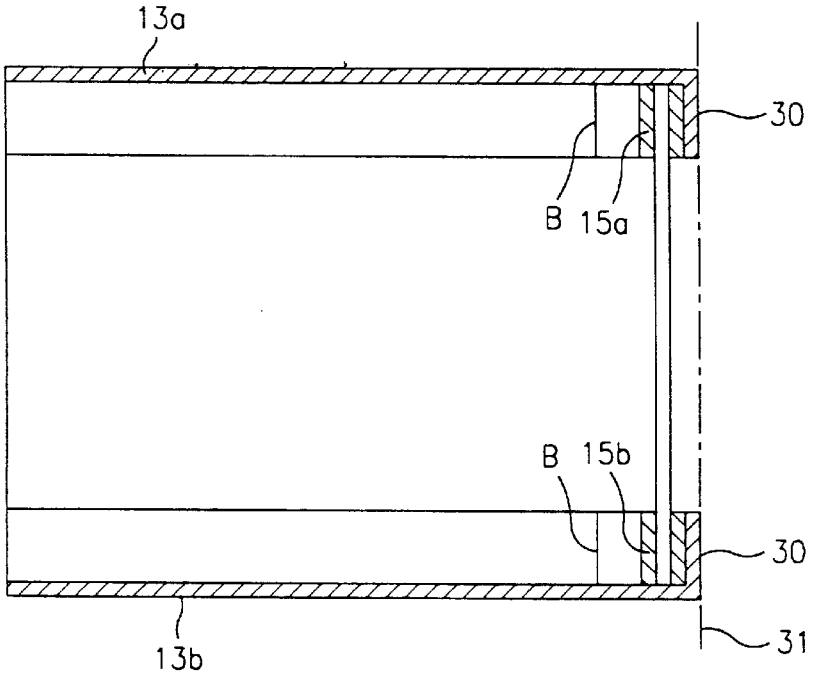
FIG. 7B CONVENTIONAL ART
FIG. 7B is a cross-sectional plan view illustrating a state in which the step rear rollers traveling along the terminal rail have jumped up onto a portion A of the terminal rail in the conventional art.
Figure 8A:
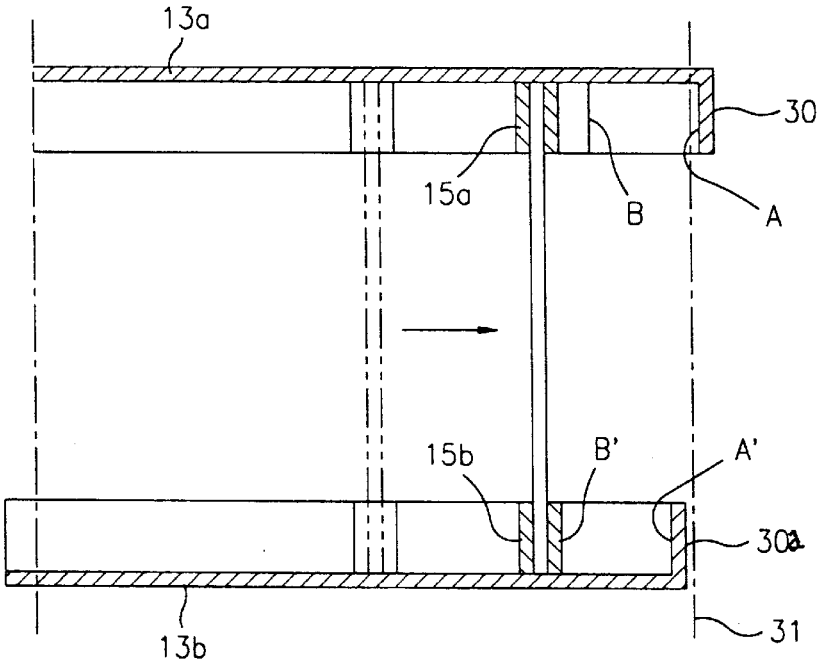
FIG. 8A is a cross-sectional plan view illustrating a state in which each of the step rear rollers traveling along the terminal rail according to the present invention has reached up to a curve start point B.
Figure 8B:
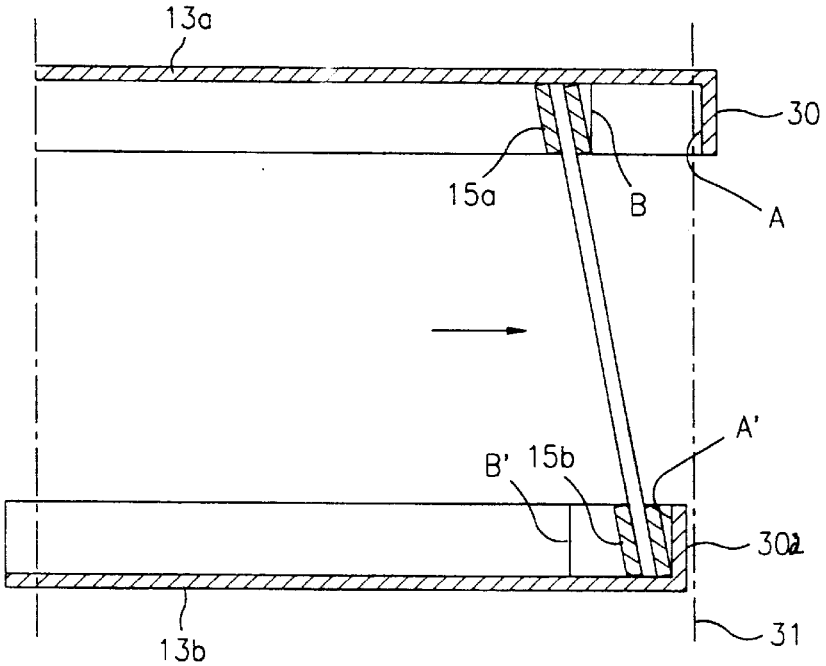
FIG. 8B is a cross-sectional plan view illustrating a state in which one step rear roller traveling along the terminal rail according to the present invention has jumped up onto portion A of the terminal rail.
Figure 8C:
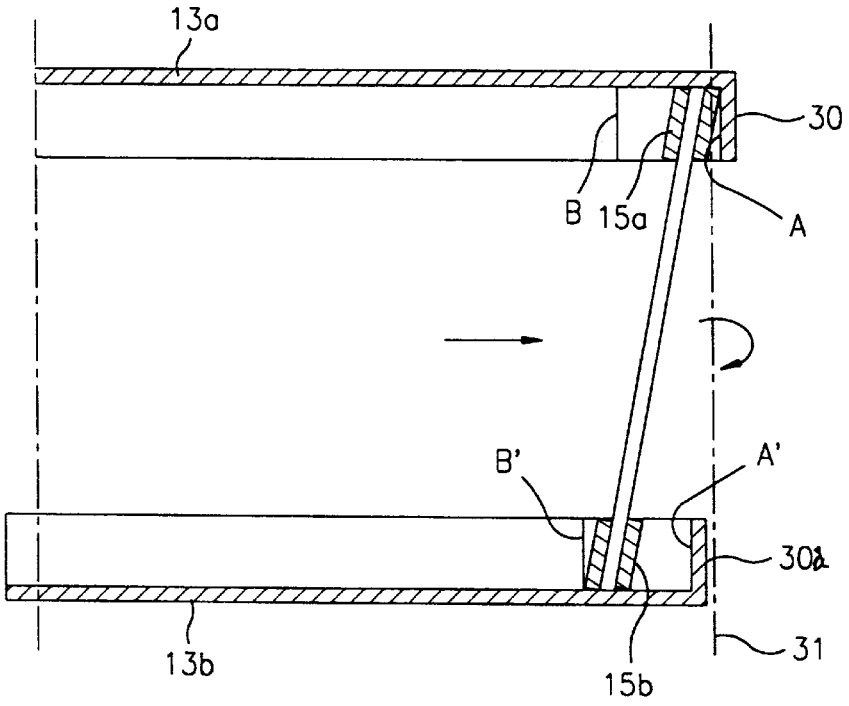
FIG. 8C is a cross-sectional plan view illustrating a state in which another step rear roller traveling along the terminal rail according to the present invention has jumped up onto portion A of the terminal rail.
Figure 9:
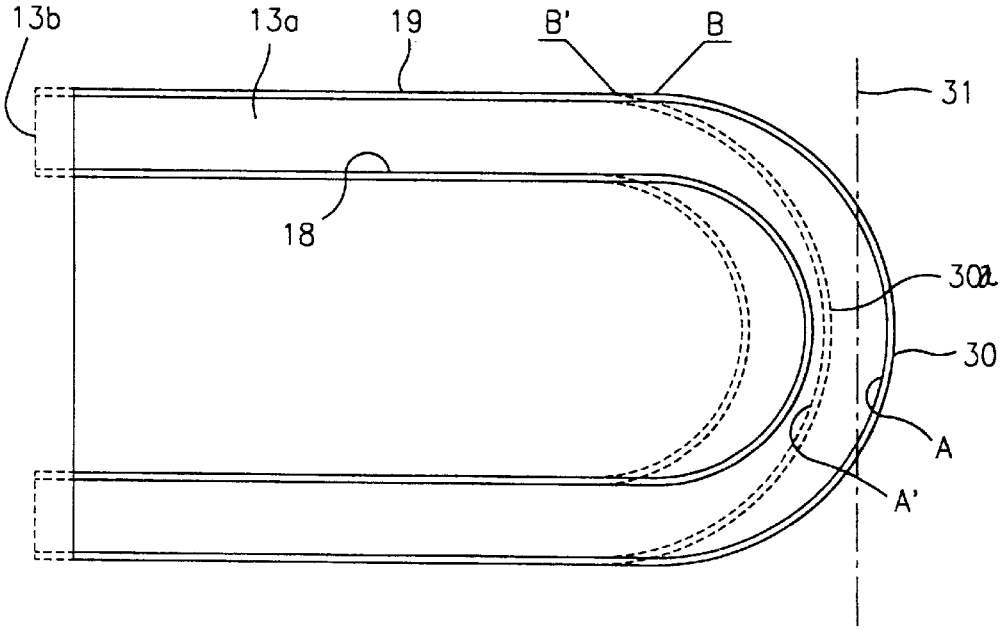
FIG. 9 is a schematic compose view illustrating an installation of a terminal rail according to the present invention.

As shown in FIGS. 8A–8C and 9, there exists a phase difference between a parallel pair of terminal rails 13*a*, 13*b* which respectively receive corresponding ones of a pair of step rear rollers 15*a*, 15*b*, so that curve apexes 30*a*, 30*b* of the paralleled terminal rails 13*a*, 13*b* are made uneven in parallel placement by a predetermined offset distance. Here, respective curvatures for the terminal rails 13*a*, 13*b* are identical to each other.

That is, the one terminal rail 13*b* of the terminal rail pair 13*a*, 13*b* is set back by a predetermined offset distance from a reference line 31, and the other terminal rail 13*a* is extended forwardly by the same predetermined offset distance from the reference line 31, for thereby obtaining a relative linear displacement between the respective terminal rails 13*a*, 13*b*.

At this time, there occur phase differences between respective curve start points B, B' from which the terminal rails 13*a*, 13*b* start set around, between curved portions A, A' of outer casings 19 of the terminal rails 13*a*, 13*b* upon which the step rear rollers 15*a*, 15*b* impact by inertia, and between curve apexes 30, 30*a*. Therefore, the step rear rollers 15*a*, 15*b* are irregularly guided along respective curved portions of the terminal rails 13*a*, 13*b* due to the phase differences, whereby either of the step rear rollers 15*a*, 15*b* travels along the channel formed in each of the terminal rails in contact with the semicircular lower casing 18 of the terminal rails 13*a*, 13*b*.

That is, either of the step rear rollers 15*a*, 15*b* smoothly rolls through the channel of the terminal rail while it is in contact with the lower casing 18, so that it is possible to completely eliminate the noise and vibration caused by impacts of the step rear rollers 15*a*, 15*b*.

Although there may occur a slight twisting of the step resulting from the lengthwise phase difference between the terminal rail pair 13*a*, 13*b*, such a step twisting can be easily absorbed by the gap allowance and therefore it is inconsequential.

Also, the terminal rail system for an escalator according to the present invention can be obtained by simply adjusting relevant engagement members of the conventional terminal rail system.

As described above, in the terminal rail system according to the present invention, when the step rear rollers of an escalator step have reached up to respective curve start portions of the channel formed through the terminal rails, either of the step rear rollers remains in contact with the lower casing, for thereby almost completely eliminating the noise and vibration caused by the impact of the step rear rollers on the upper casing of the terminal rail.

Further, a pulsation of the steps with passengers thereon is significantly decreased due to the lack of such impact, and prolonged longevity of the step rear rollers is also obtained.

Still further, the terminal rail system according to the present invention is not affected by the gap between the step rear roller and the upper casing, or by the roughness of contact surfaces of the step rear rollers, which have been main factors causing noise, thereby decreasing the fabrication and assembly time and improving productivity.

What is claimed is:

1. In a pair of terminal rails for an escalator which include a pair of curved portions thereof for guiding therearound a pair of step rear rollers engaged to an escalator step, and a pair of linear portions for guiding therealong the pair of step rear rollers toward the curved portions, the terminal rails comprising the curved portions thereof having identical curvatures therebetween, a curve start point of either of the terminal rails being displaced from that of the other of the terminal rails.

2. The terminal rails of claim 1, wherein one of the curved portions of the terminal rails is set back by a predetermined distance toward the linear portion thereof.

3. The terminal rails of claim 1, wherein one of the linear portions of the terminal rails is formed longer than the other thereof.

* * * * *